US008241074B2

(12) United States Patent
Watford et al.

(10) Patent No.: US 8,241,074 B2
(45) Date of Patent: Aug. 14, 2012

(54) CIRCUIT BREAKERS WITH LUG SCREW RETENTION AND METHODS FOR MANUFACTURING SAME

(75) Inventors: Russell T. Watford, Lawrenceville, GA (US); Timothy Biedrzycki, Powder Springs, GA (US); Brian Timothy McCoy, Lawrenceville, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 303 days.

(21) Appl. No.: 12/725,809

(22) Filed: Mar. 17, 2010

(65) Prior Publication Data

US 2010/0236908 A1 Sep. 23, 2010

Related U.S. Application Data

(60) Provisional application No. 61/161,150, filed on Mar. 18, 2009.

(51) Int. Cl.
*H01R 4/36* (2006.01)

(52) U.S. Cl. ..... 439/814; 200/293; 218/155; 335/202

(58) Field of Classification Search ..... 200/244, 200/293, 303, 307, 400, 401; 335/23, 26, 335/35, 36, 8, 132, 202; 337/12, 13, 16, 337/35, 36, 86, 113, 381, 400; 361/626–628, 361/631, 634, 637, 641–647, 652; 439/620–622, 439/217, 224, 698, 709–717, 723, 724, 810–814, 439/830

See application file for complete search history.

(56) References Cited

U.S. PATENT DOCUMENTS

| | | | | | |
|---|---|---|---|---|---|
| 3,344,394 | A * | 9/1967 | Kingsbury et al. | 439/814 |
| 4,478,478 | A * | 10/1984 | Durand et al. | 439/723 |
| 4,646,199 | A | 2/1987 | M Sadoques et al. | |
| 4,809,132 | A | 2/1989 | Arnold | |
| 4,830,627 | A * | 5/1989 | Heng et al. | 439/586 |
| 5,145,415 | A | 9/1992 | Doudon | |
| 5,249,989 | A * | 10/1993 | Alsch | 439/812 |
| 5,436,605 | A * | 7/1995 | Mrenna | 335/202 |
| 5,747,741 | A * | 5/1998 | Alsch | 174/84 C |
| 5,875,093 | A | 2/1999 | White | |
| 6,211,759 | B1 * | 4/2001 | Little et al. | 335/202 |
| 6,407,354 | B1 * | 6/2002 | Turner et al. | 218/155 |
| 6,529,112 | B1 | 3/2003 | Leone | |
| 6,614,334 | B1 * | 9/2003 | Gibson et al. | 335/202 |
| 7,545,247 | B2 * | 6/2009 | Zindler | 335/202 |
| 7,575,486 | B2 * | 8/2009 | Weber et al. | 439/811 |
| 7,701,313 | B2 * | 4/2010 | Kim | 335/202 |
| 2006/0018731 | A1 | 1/2006 | Klepka | |
| 2009/0202366 | A1 | 8/2009 | Addink | |

FOREIGN PATENT DOCUMENTS

| | | | |
|---|---|---|---|
| DE | 19513281 | A1 | 10/1996 |
| EP | 0681342 | A1 | 11/1995 |
| FR | 2612340 | A1 | 9/1988 |

* cited by examiner

*Primary Examiner* — Michael Friedhofer

(57) ABSTRACT

Embodiments provide circuit breakers with stops adapted to prevent a lug screw from falling out of circuit breaker and/or to prevent the lug screw from blocking a wire receiver of circuit breaker lug body. In one aspect, a circuit breaker is provided having a circuit breaker housing; a lug assembly retained in the circuit breaker housing, the lug assembly including a threaded screw hole; a lug screw having driving end and a threaded shaft inserted in the threaded screw hole; and a back-out stop adapted to contact the driving end and limit an extent of backward movement of the lug screw out of the threaded screw hole. Other aspects are provided.

24 Claims, 9 Drawing Sheets

CIRCUIT BREAKERS WITH LUG SCREW RETENTION AND METHODS FOR MANUFACTURING SAME

RELATED APPLICATION

This application claims priority to Provisional Application Ser. No. 61/161,150 filed on Mar. 18, 2009, and entitled "AFCI 2P INSTA WIRE NEUTRAL POLE" the disclosure of which is hereby incorporated by reference herein in its entirety.

FIELD OF THE INVENTION

The present invention relates generally to circuit breakers, and more specifically to circuit breaker housings.

BACKGROUND OF THE INVENTION

A conventional circuit breaker is typically included within an electrical circuit to protect the circuit from persistent over current conditions, short circuits, faults, etc. Various wires of the electrical circuit are connected to the circuit breaker by an installer. These wires may include "load neutral" and/or "load power" wires. To facilitate the connection of such wires to the circuit breaker, a conventional circuit breaker may include "wire lugs", sometimes simply referred to as "lugs". One type of lug which may be used in a circuit breaker includes a "lug body" having a hole or receiver intended to receive the wire (hereinafter the "wire receiver") and a threaded hole which may be perpendicular to, and communicate with the wire receiver. (Lugs vary widely. A lug may not have a lug body, for example, but only a screw through two plates. In addition, a wire receiver may take different forms in different lugs. For example, two metal plates which can be pressed together to hold a wire can be a wire receiver.) This type of lug may also include a "lug screw" which may be inserted into the threaded hole. When the lug screw is inserted into the lug body, the combination is referred to herein as a "lug assembly." When the installer connects a wire to the circuit breaker, the installer generally strips an end of the wire and inserts it into the wire receiver of the lug body far enough such that, when the installer tightens the lug screw, the body of the screw will enter the wire receiver and contact the inserted wire. The installer will then normally tighten the lug screw sufficiently to prevent the wire from being pulled from the lug assembly under conditions of normal use.

Circuit breakers are typically shipped with one or more lug assemblies set up such that the lug screws are screwed into the lug bodies, but not so far that any part of the screw enters the wire receiver from the threaded screw hole. This obviates the need for the installer to install the lug screw into the lug body, or to clear the lug screw from the wire receiver prior to inserting a wire.

SUMMARY OF THE INVENTION

In accordance to one aspect of the invention, a circuit breaker is provided. The circuit breaker includes a circuit breaker housing; a lug assembly retained in the circuit breaker housing, the lug assembly including a lug body having a threaded screw hole, and a lug screw having a driving end and a threaded shaft inserted in the threaded screw hole; and a back-out stop positioned to contact the driving end so as to limit an extent of retraction of the lug screw out of the threaded screw hole.

In accordance with another aspect of the invention, another circuit breaker is provided. The circuit breaker includes a circuit breaker housing; a lug assembly having lug body with a threaded screw hole, and a lug screw having a threaded shaft connected to a screw head, wherein the threaded shaft is threaded into the threaded screw hole, and the lug assembly is retained in the circuit breaker housing; and an advancement stop positioned to contact the screw head and limit an extent to which the threaded shaft may advance in the threaded screw hole when the lug screw is subjected to forces ordinarily experienced during shipping and handling of the circuit breaker.

In accordance with another aspect of the invention, a method for manufacturing a circuit breaker is provided. The method includes providing a lug assembly having a lug body with a threaded screw hole and a lug screw having a driving end and a threaded shaft threaded into the threaded screw hole; placing the lug assembly into a base portion of a circuit breaker housing; installing a cover portion of the circuit breaker housing to the base portion thereby retaining the lug assembly between the base and cover portions; and positioning a back-out stop to contact the driving end so as to limit an extent of retraction of the lug screw out of the threaded screw hole.

In another aspect of the invention, another method for manufacturing a circuit breaker is provided. The method includes providing a lug assembly having lug body with a threaded screw hole and a wire receiver, and a lug screw with a screw head and threaded shaft threaded into the threaded screw hole; placing the lug assembly into a base portion of a circuit breaker housing; installing a cover portion of the circuit breaker housing to the base portion thereby retaining the lug assembly between the base and cover portions; and positioning an advancement stop so as to contact the screw head and limit an extent of advancement of the lug screw in the threaded screw hole when the lug screw is subject to forces ordinarily experienced during shipping and handling of the circuit breaker.

Still other aspects, features, and advantages of the present invention may be readily apparent from the following detailed description by illustrating a number of exemplary embodiments and implementations, including the best mode contemplated for carrying out the present invention. The present invention may also be capable of other and different embodiments, and its several details may be modified in various respects, all without departing from the spirit and scope of the present invention. Accordingly, the drawings and descriptions are to be regarded as illustrative in nature, and not as restrictive. The invention is to cover all modifications, equivalents, and alternatives falling within the spirit and scope of the invention.

DETAILED DESCRIPTION

Figure 1A:
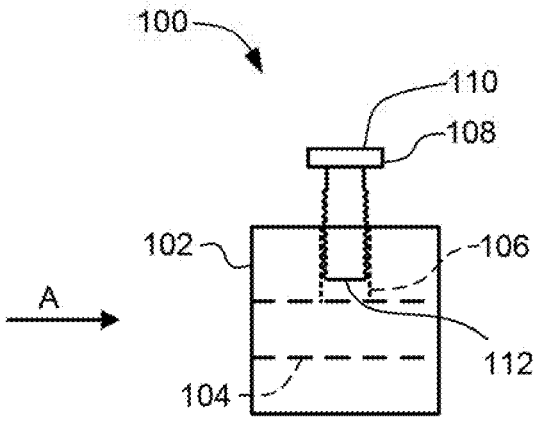
FIG. 1A is a side elevation view of a lug assembly according to the prior art.

Circuit breaker housings may typically be designed to contain, mount or retain a variety of parts, including a lug assembly, in a plurality of compartments. The circuit breaker housings may be manufactured in two or more parts or housing portions into which the variety of parts may be installed. The circuit breaker housing portions may then be joined to form the compartments which contain the parts. One exemplary compartment is a lug assembly compartment which may be designed so that a tool may access a lug screw and so that a wire may be inserted into a wire receiver after the circuit breaker housing is assembled.

As described above, when a circuit breaker is manufactured and/or assembled at a factory, one or more lug or lug assemblies may be installed in the circuit breaker. For example, the lug assembly may be set up such that a lug screw is partially screwed into a threaded hole (referred to herein as a "threaded screw hole") in a lug body. The lug screw may generally be screwed in far enough to engage the lug screw threads, but not so far that the screw would prevent a wire from being inserted into the wire receiver. This lug assembly set-up may facilitate installation of the circuit breaker, because the installer can simply insert a wire into the lug assembly wire receiver without having to back out the lug screw to clear the wire receiver. The set-up may be desirable to installers.

During shipping and handling of a circuit breaker, however, the circuit breaker may experience jolting, vibration and/or other forces and/or motions which may cause the lug screw to turn further into or to fall out of the threaded screw hole.

If the lug screw turns further into the threaded screw hole, it may block the wire receiver to such an extent that it would prevent a wire from being properly inserted into the wire receiver. In such a case, the installer may not be able to insert a wire sufficiently far into the wire receiver of the lug so that the lug screw may engage and secure the wire. The installer would then have to back the lug screw out a sufficient amount to enable the wire to fit into the wire receiver. This would create additional work and increase installation time for the installer. In addition, during the act of reversing the lug screw to clear the wire receiver, it may be relatively easy to entirely disengage the lug screw from the lug hole threads, thereby causing the lug screw to separate from the circuit breaker, and possibly fall to the floor. In this case the lug screw may have to be located by the installer and would need to be rethreaded into the lug assembly, a potentially difficult task in view of the size and location of the lug screw/lug assembly, and the close proximity of these parts to the circuit breaker housing. This may increase the time and effort required for installation.

If the lug screw backs out of the threaded screw hole during shipping and/or handling, it may separate from the circuit breaker and may become lost when the circuit breaker is unpackaged, or it may fall to the floor, or it may simply need to be re-threaded into the threaded screw hole by the installer. Again, this may cause frustration and increase the time required for installation of the circuit breaker into an electrical panel, and may also be cause for returns by installers or vendors.

In addition to these problems, installers may desire a relatively higher initial driving torque, i.e., the torque required to initially drive the lug screw before it makes contact with a wire in the wire receiver. Such higher initial driving torque may be greater than the torque required to drive a typical lug screw which has not engaged a wire in the wire receiver. The initial driving torque may also be less that the final torque value specified by a breaker manufacturer to secure a wire in the circuit breaker.

The problems described above have been addressed by manufacturers, albeit in a way which may introduce an additional problem. Prior to the present invention, manufacturers have designed the lug assembly such that the lug screw and the threaded screw hole have different thread pitches. The difference in thread pitch may create sufficient friction so as to increase the amount of torque required to turn the screw. During assembly, as the manufacturer drives the lug screw partially into the threaded screw hole, the thread pitch mismatch may cause friction between the screw threads and the screw hole threads to increase as the screw enters further into the hole. This may occur because more thread contact, and therefore friction, occurs between the screw and the hole.

A problem with this prior art technique is that, when using ordinarily acceptable manufacturing tolerances, the lug screw thread pitch and the threaded screw hole thread pitch may vary. This variance may cause the required driving torque to fall to almost zero if the thread pitches approach each other. On the other hand, if the thread pitches diverge from each other, the driving torque may increase to a point that it approaches the final driving torque required to secure a wire, or to a point that the lug screw binds and the breaker is unusable, or the lug screw is at least very difficult to screw in. While these problems may be addressed by increasing the manufacturing precision of the lug screw and the lug body, such an increase in precision may bring a prohibitive increase in cost.

Accordingly, there is a need for apparatus, systems and methods to prevent a lug screw from either falling out of a lug body, or advancing too far into a wire receiver. Furthermore, there is a need to increase the initial driving torque to a desired level for a lug screw in a circuit breaker.

In one or more aspects of the invention, an appendage may be provided (e.g., attached to or molded into the circuit breaker housing) such that the appendage covers a portion of a screw top of the lug screw. The appendage may be located such that when the circuit breaker is assembled, the lug screw head is positioned to abut the appendage and the lug screw is thereby prevented from backing out of the threaded screw hole. This appendage may be referred to herein as a "lug screw back-out stop", or simply as a "back-out stop." The back-out stop may stop the screw from retracting backward, e.g., in a direction out of the lugs screw hole. Alternatively, the back-out stop may be located and positioned where it does not abut the lug screw head upon assembly of the circuit breaker, but is located sufficiently close to the lug screw head such that, should shipping and/or handling of the circuit breaker cause the lug screw to begin to back out of the threaded screw hole, the back-out stop would contact the lug screw and limit an extent of retraction of the lug screw to prevent the lug screw threads from disengaging the threaded screw hole threads. In another alternative embodiment, the back-out stop may be located such that if the lug screw threads do disengage from the threaded screw hole threads, the back-out stop may prevent the lug screw from exiting the screw hole and position the lug screw so that it may be easily rethreaded into the lug body, and reduce the potential for cross threading the threads.

In one or more embodiments, the back-out stop may be dimensioned such that it would perform as described in the preceding paragraph, while still enabling the lug screw to be driven by an installer with a tool, such as a flat head screwdriver, a Phillips head screwdriver, or a Roberts square head driver.

In one or more aspects of the invention, a second appendage may be provided (e.g., attached to or molded into the circuit breaker housing) such that the second appendage undercuts and overlaps a portion of the bottom of the lug screw head. The second appendage may be located such that when the circuit breaker housing is assembled, the bottom of the lug screw head abuts the second appendage and the lug screw is thereby prevented from turning further into (or penetrating) the threaded screw hole. This second appendage may be referred to herein as a "lug screw advancement stop" or simply as an "advancement stop." Alternatively, the advancement stop may be located such that it does not abut the bottom of the lug screw head upon assembly of the circuit breaker housing, but rather is located sufficiently close to the bottom of the lug screw head such that, should shipping and/or handling of the circuit breaker cause the lug screw to advance into the threaded screw hole, the advancement stop would contact the screw head and prevent the lug screw from penetrating so far into the threaded screw hole that the lug screw block the wire receiver of the lug body so as to prevent insertion of a wire therein.

An advantage of the advancement stop over the known thread mismatching method for preventing movement of the lug screw during shipping and handling is that the advancement stop may be controlled with a tighter tolerance and a lower cost than is required to control the tolerance of thread pitches.

In one or more aspects of the invention, the advancement stop may be sized so that it presses against a shaft of the lug screw (e.g., the threads thereof, or an unthreaded portion thereof), thereby preventing the lug screw from vibrating during shipping and handling of the circuit breaker. Preventing the lug screw from vibrating may serve to prevent the lug screw from backing out of or advancing into the lug body whether or not the lug screw head contacts either the back-out stop or the advancement stop.

In one or more aspects of the invention, the advancement stop may be dimensioned such that it will perform as described in the preceding paragraph, and when an installer begins driving the lug screw into the threaded screw hole, upon contact therewith, the advancement stop will deform (either through plastic or elastic deformation) or break, while providing a desired initial level of resistance in the form of increased initial driving torque. Depending upon placement of and nature of the advancement stop, the initial driving torque may persist until a wire is contacted by the lug screw, or may fall off or reduce once the advancement stop deforms or breaks. In any case, once the lug screw contacts a wire in the wire receiver, the installer may be expected to apply a manufacturer recommended driving torque to the lug screw.

In one or more aspects of the invention, the circuit breaker housing may include both the back-out stop and the advancement stop so that the lug screw may be confined to a predetermined position or within a predetermined translational range, despite forces which may be experienced by the screw during shipping and handling.

The principles of the present invention are not limited to the illustrative examples depicted herein, but may be applied and utilized in any type of circuit breaker, such as a single pole breaker, multi-pole circuit breaker, ground fault circuit interrupter (GFCI), or arc fault circuit interrupter (AFCI). Further, the present invention may be applied with any type of lug assembly, whether the lug assembly may be used for neutral load terminals, power terminals, load terminals, or the like.

These and other embodiments of apparatus, systems and methods of the present invention are described below with reference to FIGS. 2-9. Like reference numerals used in the drawings identify similar or identical elements throughout the several views. The drawings are not necessarily drawn to scale.

Referring now to FIG. 1A, a lug assembly 100 of a type commonly used in modern circuit breakers in the prior art is shown in a side elevation schematic view. Lug assembly 100 may include lug body 102, wire receiver 104 (shown as a dashed line), threaded screw hole 106 (shown as a dotted line), and lug screw 108. The lug screw 108 may have a driving end 110, i.e., an end to which a tool (not shown) may be applied to drive the screw, and an engagement end 112, e.g., an end which may engage a wire (not shown) to secure it. The lug assembly 100 may be connected to an electrical lead (not shown) within the circuit breaker (not shown). The threaded screw hole 106 may be in communication with wire receiver 104 so that a lug screw 108, which is driven into threaded screw hole 106, may engage and secure a wire (not shown) which has been inserted into wire receiver 104. Wire receiver 104 may be a smooth bore which is adapted to receive a wire (not shown) from an electrical circuit (not shown). Although the wire receiver 104 is shown as a throughbore hole extending completely through the lug body 102 from left to right, it should be understood that the wire receiver 104 does not need to pass completely through lug body 102. Instead, the wire receiver 104 may extend only part way through lug body 102, so long as it extends from one end of lug body 102 to position the wire under the threaded screw hole 106, where the lug screw 108 may engage and secure the wire (not shown) which has been inserted, e.g., in the direction indicated by arrow A, into wire receiver 104. For example, some configurations may include a single hole on one side of the lug body, such as when formed through stamping or bending. The inserted wire may be a #8, 10, 12 or 14 AWG wire, for example. Other wire gauges may be used.

Figure 1B:
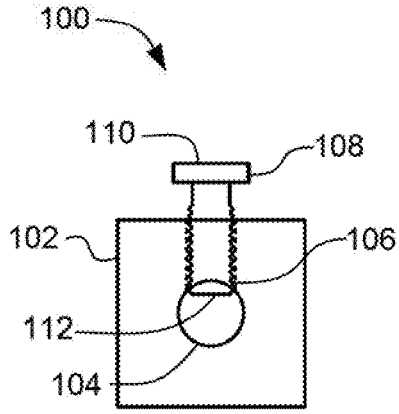
FIG. 1B is a side elevation view of the lug assembly of FIG. 1A turned 90°.

Referring to FIG. 1B, the lug assembly 100 of FIG. 1A is shown rotated 90° as compared to FIG. 1A. In this view, a load wire (not shown) may be inserted into the wire receiver 104 in a direction directly into the page. Also in this view, the lug screw 108 is shown driven further into the threaded screw hole 106 such that it has partially entered into the wire receiver 104.

In operation, an electrician or other installer may insert a load wire into wire receiver 104 in the direction of arrow A (FIG. 1A), far enough to extend under lug screw 108 and threaded screw hole 106, and then tighten lug screw 108 until the load wire (not shown) is properly secured.

Figure 2:
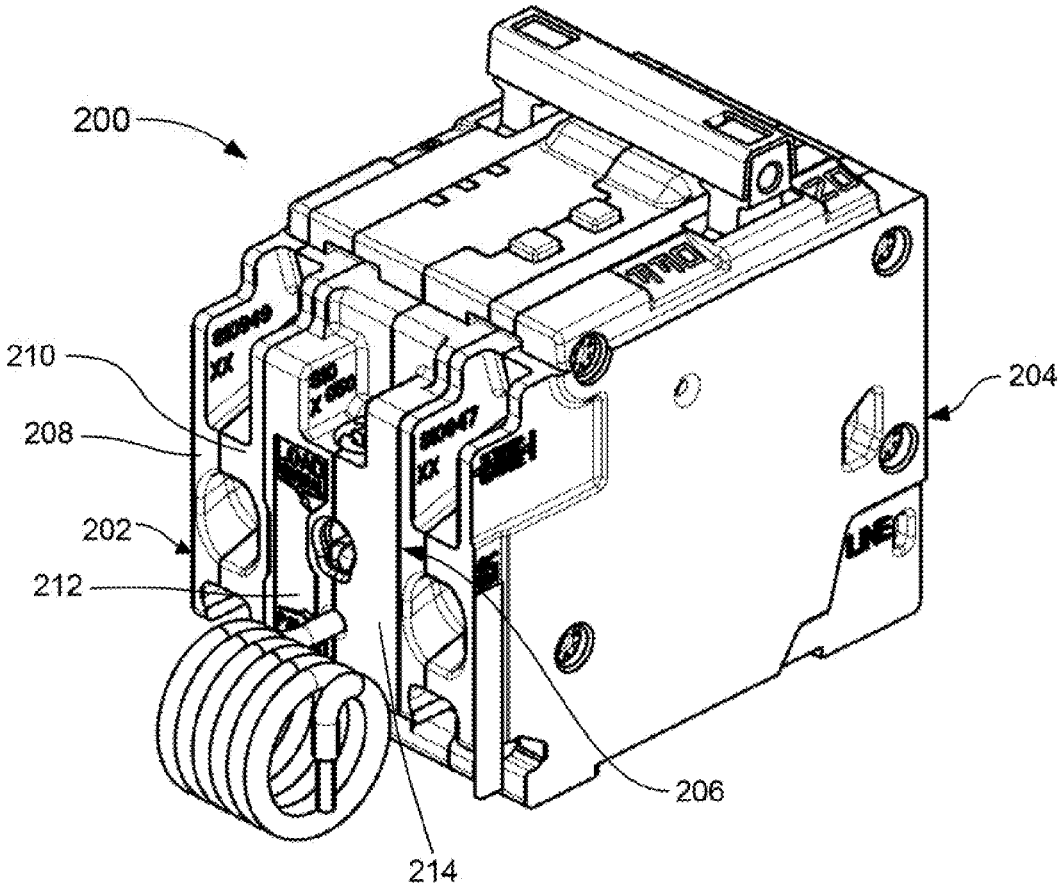
FIG. 2 is a perspective view of a circuit breaker.

Referring to FIG. 2, a two pole circuit breaker 200 is shown, including two mechanical poles 202, 204 and one central electronic pole 206. It can be seen in FIG. 2 that each pole of the circuit breaker 200 may be contained in a circuit breaker housing which may be formed from two or more circuit breaker housing portions which are fastened together to form the circuit breaker housing for that pole. For example, the circuit breaker housing for the mechanical pole 202 may be formed by mechanical pole housing base portion 208 and mechanical pole housing cover portion 210, and the electronic pole 206 may be formed by electronic pole housing base portion 212 and electronic pole housing cover portion 214. The mechanical pole 204 may be formed of similar construction.

Figure 3A:
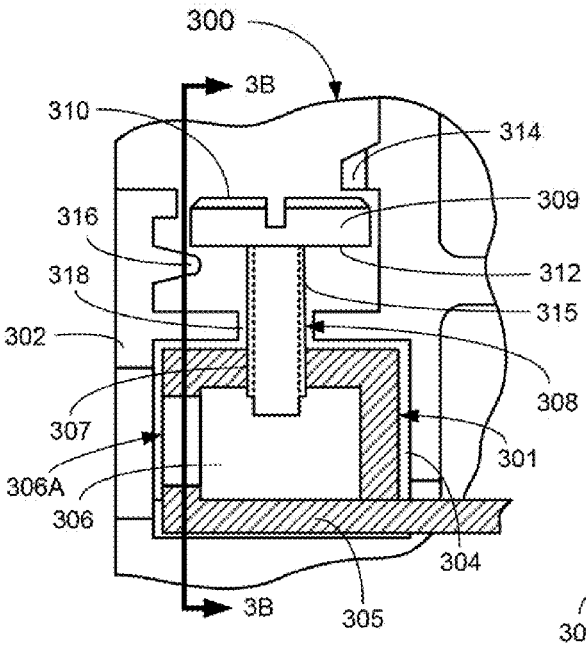
FIG. 3A is a partially cross-sectioned schematic side view of a portion of a circuit breaker housing base portion containing a lug assembly in accordance with an illustrative embodiment of the invention.

FIG. 3A is a schematic side view of a portion of a circuit breaker 300 including a base lug housing 302, which may be a sub-portion of a pole housing portion, such as, for example, base housing portion 212 of FIG. 2. Base lug housing 302 may retain lug assembly 301 in accordance with an illustrative embodiment of the invention. FIG. 3A is a depiction of lug housing 302 prior to installation of circuit breaker 300 into an electrical panel board. Base lug housing 302 may include lug compartment 304, lug body 305, wire receiver 306, threaded screw hole 307, lug screw 308, wire receiver entrance 306A, lug screw head 309, the screw head 309 having a top side 310 adapted to be engaged by a tool (e.g., screw driver) and a bottom side 312, back-out stop 314, advancement stop 316 and lug screw aperture 318. It should be noted that although the lug screw 308 depicted in FIG. 3A includes a lug screw head 309 having both a top side 310 and a bottom side 312, in some embodiments of the invention the lug screw may not have a head 309 which overhangs a shaft 315 of the screw 108. In such cases, the lug screw would have a top side 310, but there would be no head which overhangs the screw shaft 315. The term lug screw as used herein denotes any type of threaded member which may be accessed on a driving end with a tool, such as a set screw, cap screw, Phillips head screw, flat head screw, or the like.

The base lug housing 302 shown schematically in FIG. 3A may attach to a cover lug housing 311 (FIGS. 3B and 3C), which in turn may be a sub-portion of a pole housing portion, such as, for example cover housing portion 214 of FIG. 2. The manner in which the base lug housing 302 attaches to other portions of the pole housing is not shown for the sake of simplicity.

Back-out stop 314 is depicted in side view in FIG. 3A as an integral part of the base lug housing 302 which is cantilevered over a portion of the lug screw head 309. It should be understood, however, that this is merely an illustrative example and should not be used to limit the scope of the invention. For example, any cross sectional shape and size may be used, so long as back-out stop 314 extends over the top 310 of lug screw head 309 a sufficient distance to prevent lug screw 308 from backing out of the threaded screw hole 307. In some embodiments, the back-out stop 314 does not have to be integrally formed. As noted above, in some embodiments, the lug screw 308 may have a top 310, but not a screw head 309. In such cases, back-out stop 314 needs merely to extend over the top 310, just as in the case of a lug screw 308 having a screw head 309. In some embodiments, the back-out stop 314 may be of a size and/or shape such that it will prevent the lug screw 308 from backing out of the threaded screw hole 307, but also that it will not prevent a tool from being used to drive the lug screw 308 into the threaded screw hole 307. Alternatively, the back-out stop 314 may be constructed of a material easily moved or deformed by a driving tool. In such a case, the design of the back-out stop 314 need not provide unobstructed access by a driving tool, as long as it may be easily removed by the driving tool (e.g., by rotation of the driving tool). An illustrative example of a back-out stop 314 is further described below with reference to the detailed description of FIGS. 3B and 3C.

In FIG. 3A, back-out stop 314 is depicted a being located a short distance from lug screw head 309. In some embodiments, back-out stop 314 may be located either abutting lug screw head 309 when lug assembly 301 is assembled in base lug housing 302, or any distance from lug screw head 309 which is not so far that lug screw 308 may back entirely out of threaded screw hole 307 such that lug screw 308 comes out of threaded screw hole 307. So long as lug screw 308 is prevented from falling out of threaded screw hole 307, even if the lug screw threads disengage from the lug hole threads, the lug screw 308 may easily be re-threaded into the lug body 305.

Furthermore, while back-out stop 314 may advantageously be molded as an integral part of the base lug housing 302 and/or cover 311, it may instead be attached to the base lug housing 302 and/or cover 311 as a separate component by any means strong enough to resist a reversing lug screw 308 motivated by forces experienced during shipping and handling of the circuit breaker. Such means may include, for example, the separate component including the back-out stop, being held by the base lug housing 302 and/or cover 311 such as by a snap fit or friction, or by being glued or otherwise fastened to the base lug housing 302 and/or cover 311 at a position adjacent to the screw head 309.

Any material may be used to form back-out stop 314, so long as it is strong enough to resist the motion of a reversing lug screw 308 which is motivated by forces normally experienced during shipping and handling of the circuit breaker. For example, the back-out stop 314 may be manufactured from a thermoplastic or thermoset material, among others. Other materials may be used.

Advancement stop 316 is depicted in side view in FIG. 3A as an integral part of the base lug housing 302 which is cantilevered under a portion of the lug screw head 309. Any cross sectional shape and size may be used, so long as the advancement stop 316 extends under the bottom 312 of lug screw head 309 a sufficient distance to prevent lug screw 308 from advancing into lug body 305 when lug screw 308 is motivated by forces normally experienced during shipping and handling of a circuit breaker.

Figure 5A:
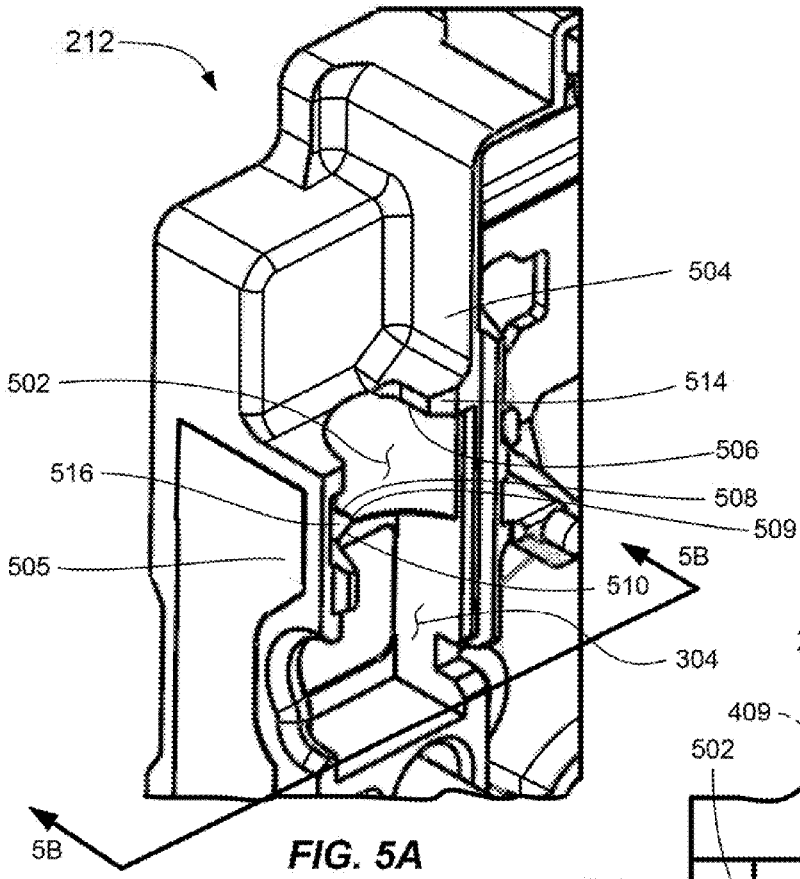
FIG. 5A is a partial perspective view of an electronic pole housing portion, including embodiments of a back-out stop and a advancement stop of the present invention.
Figure 5B:
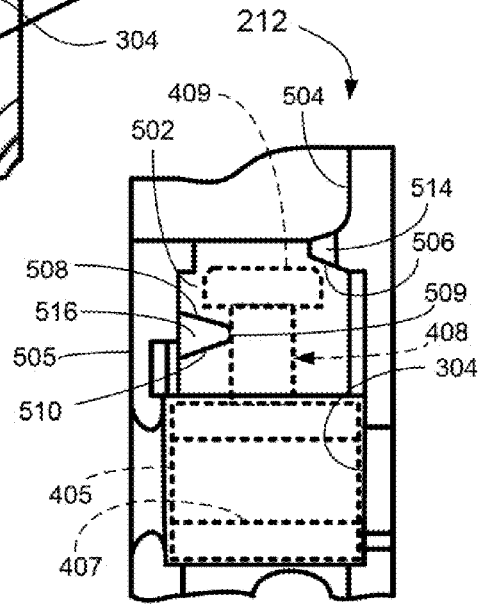
FIG. 5B is a partial side view of an electronic pole housing portion taken along line 5B-5B of FIG. 5A.

In some embodiments, such as depicted in FIGS. 5A and 5B, for example, the advancement stop 516 may have a first sloping surface 508 which slopes toward a rounded nose 509, and a second sloping surface 510 sloping away from the rounded nose 509. In some embodiments, the nose 509 may contact threads of a lug screw 408 (lug screw 408 and lug body 405 shown dotted to show positioning relative to the 304, 502). In other embodiments, the nose 509 may not contact the threads.

In FIG. 3A, the advancement stop 316 is depicted being located a short distance from the screw head bottom 312. In some embodiments, advancement stop 316 may be located either abutting screw head bottom 312, or any distance from screw head bottom 312, which is not so far that lug screw 308 may advance into wire receiver 306 an appreciable distance. For example, the lug screw 308 may be advanced only so far so that wire entry into the wire 306 through the receiver entrance 306A is not impeded.

While advancement stop 316 may be molded as an integral part of the base lug housing 302 and/or cover 311, it may also be attached to the base lug housing 302 and/or cover 311 by any means strong enough to resist an advancing lug screw 308 motivated by such forces as may be experienced during shipping and handling of the circuit breaker. Such attachment means may include, for example, being held by the base lug housing 302 and/or cover 311 by a snap fit, by friction, or by being glued or otherwise fastened to the base lug housing 302 and/or cover 311. In some embodiments, the attachment of the advancement stop 316 to the base lug housing 302 and/or cover 311 may be strong enough to provide an initial driving torque as described above.

Any material may be used to form advancement stop 316, so long as it is strong enough to resist the motion of an advancing lug screw 308 which is motivated by forces such as may be normally experienced during shipping and handling of the circuit breaker. For example, the advancement stop 316 may be made from a thermoplastic or thermoset material, among others. Other materials may be used.

In operation, lug body 305 may be contained in lug compartment 304 and may receive a wire (not shown) through wire entrance 306A, and may receive lug screw 308 into threaded screw hole 307 through lug screw aperture 318. Back-out stop 314 may operate as a mechanical barrier to limit or prevent retraction movement of lug screw 308 (e.g., out of the threaded screw hole 307). Such movement might otherwise be caused by forces experienced during shipping and handling of a circuit breaker. Similarly, advancement stop 316 may operate as a mechanical barrier to limit or prevent forward translation of lug screw 308 (e.g., into threaded screw hole 307). Again, such translation might otherwise be caused by forces experienced during shipping and handling.

Figure 3B:
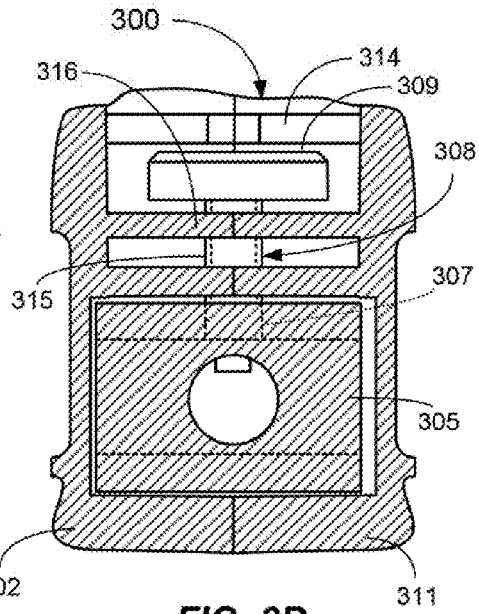
FIG. 3B is a partially cross-sectioned schematic side view of a portion of a circuit breaker housing base portion containing a lug assembly in accordance with an illustrative embodiment of the invention.
Figure 3C:
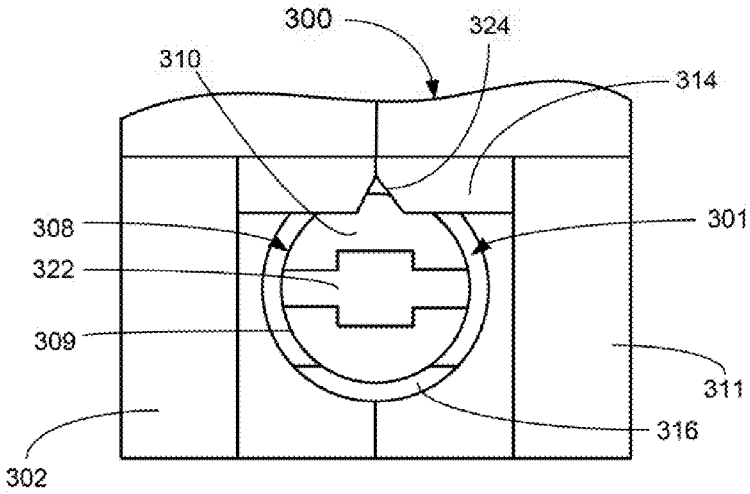
FIG. 3C is a schematic top view of a portion of a circuit breaker housing containing a lug screw in accordance with an illustrative embodiment of the invention.

FIG. 3C depicts schematic top view of the portion of circuit breaker 300 of FIG. 3A. Circuit breaker 300 includes a base lug housing 302, which may be a sub-portion of a pole housing portion, such as, for example, base housing portion 212 of FIG. 2. Base lug housing 302 and cover 311 may retain lug assembly 301, of which only lug screw head 309 (and in particular the top 310 thereof) is visible in FIG. 3B.

Circuit breaker 300 depicts an illustrative example of a back-out stop 314, which covers a portion of the top 310 of lug screw head 309. Back-out stop 314 of circuit breaker 300 covers only a portion of the top 310 of screw head 309 (e.g., the driving end). The driving end of the lug screw 308 is that end including an engagement feature (flat head screwdriver slot, Phillips head screwdriver slot, hex key recess, square head recess, star head recess or combinations, etc.) which are adapted to receive a tool. It can be seen that sufficient clearance between the engagement feature 322 and the back-out stop 314 is provided to allow a drive tool, such as a screw driver, for example, to drive the lug screw 308. In addition, the back-out stop 314 of circuit breaker 300 may include an optional notch 324 to further provide clearance for a driving tool. Other shapes may be used.

FIG. 3B illustrates a cross-sectioned side view of the circuit breaker 300 of FIG. 3A along section lines 3B-3B. As can be seen from this view, the back-out stop 314 is positioned to contact the driving end of the screw head 309 of lug screw 308 so as to limit an extent of retraction of the lug screw 308 out of the threaded screw hole 307 (shown dotted) of the lug body 305. Also shown is the advancement stop 316 which, as depicted, extends across underneath of the screw head 308. The advancement stop 316 is positioned to contact the lug screw head 309 and limit an extent to which the lug screw shaft 315 may advance in the threaded screw hole 307 when the lug screw 308 is subjected to forces ordinarily experienced during shipping and handling of the circuit breaker 300.

Figure 4:
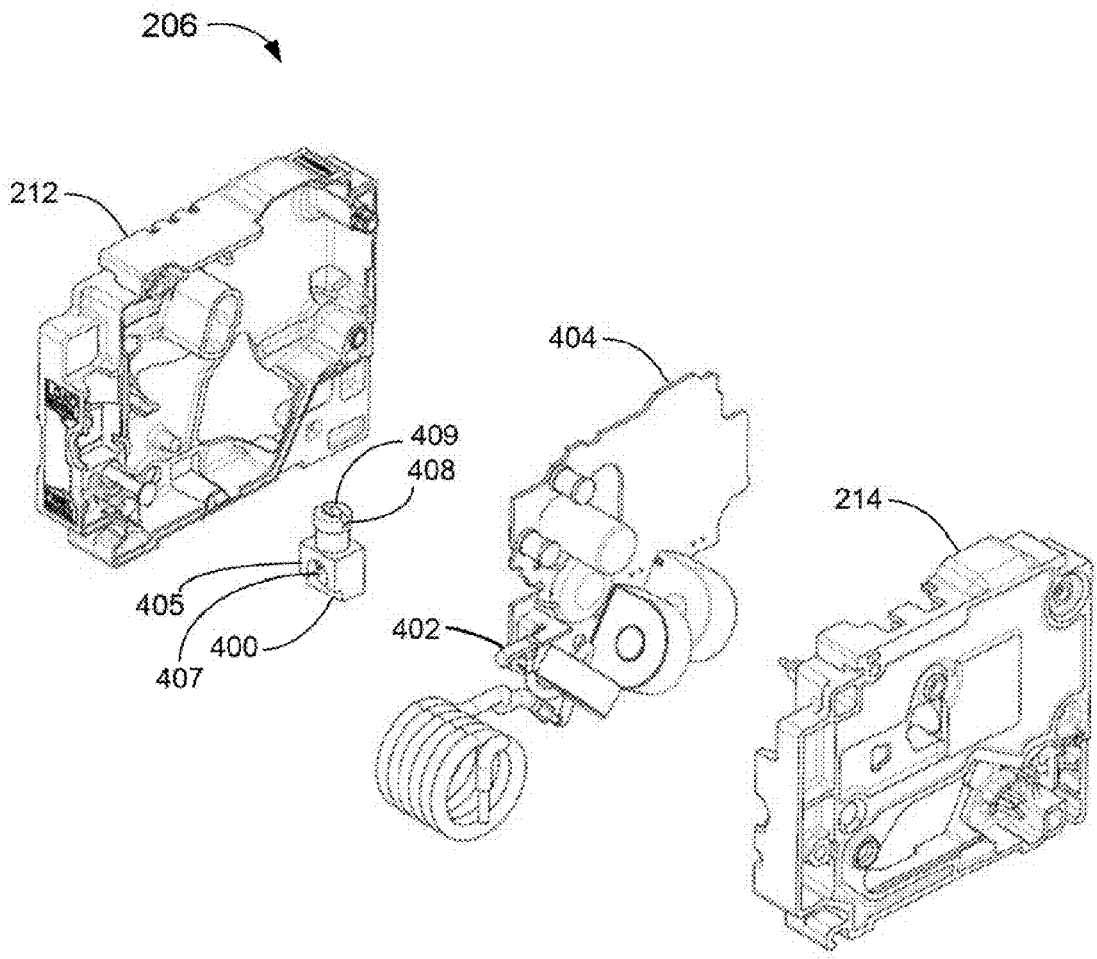
FIG. 4 is an exploded perspective view of an electronic pole of a two pole circuit breaker in accordance with embodiments of the present invention.

FIG. 4 is an exploded perspective view of the electronic pole 206 of circuit breaker 200 of FIG. 2. The electronic pole 206 may include electronic pole housing first portion 212 and electronic pole housing second portion 214, which, when assembled, form the complete housing for the electronic pole 206. The electronic pole 206 is shown assembled below in FIGS. 6A and 6B. Electronic pole 206 may contain lug assembly 400 which may fit over a neutral terminal 402. The lug assembly 400 may be as heretofore described including a lug body 405 with wire receiver 407 and lug screw 408 with screw head 409 wherein the lug screw 308 is threaded into the lug body 405. The neutral terminal 402 may be electrically connected (not shown) to printed circuit board 404, which in turn may be mounted in electronic pole housing first portion 212. Other configurations may be used.

FIGS. 5A and 5B are partial views of an electronic pole housing base portion 212, including an illustrative example of a back-out stop 514 and an advancement stop 516 of the present invention. The electronic pole base housing portion 212 may also include lug assembly compartment 504, lug screw well or recess 502, rear housing wall 504, and front housing wall 505.

In this embodiment, back-out stop 514 may be shaped as a ledge which juts out from rear housing wall 504. In addition, advancement stop 516 may be shaped as a protrusion which juts out from front housing wall 505.

In operation, lug screw (e.g., lug screw 408) (shown dotted in FIG. 5B) may be located such that lug screw head 409 (shown in FIG. 5B) would be located below back-out stop 514, and above advancement stop 516, in lug screw well 502. In operation, back-out stop 514 and advancement stop 516 may operate in the same manner as described with respect to FIG. 3A-3C above, with the lug screw head 409 stopped by the lower surface 506 of the back-out stop 514, and by the upper surface 508 of the advancement stop 516.

The advancement stop 516 may serve an additional function. When an installer begins to exert torque on a lug screw 408 which is located with its lug screw head 409 in the lug screw well 502 above the advancement stop 516, the lug screw head 409 may advance and exert a force on the advancement stop 516. As the lug screw head 409 is further advanced, the advancement stop 516 will begin to deform. As the lug screw 408 is further advanced, the advancement stop 516 will continue to deform (or break away) thereby allowing the lug screw head 409 to move toward a position below the advancement stop 516. In this way, upon contact therewith, the advancement stop 516 may perform the function of increasing an initial driving torque required to drive the lug screw 408, prior to the lug screw 408 contacting a wire which has been inserted into the wire receiver 407 (FIG. 4). In some embodiments, the initial driving torque required to advance the lug screw head 409 past the advancement stop 516 may be on the order of between about 1 to about 7 inch-pounds, in other embodiments between about 3 to about 7 inch-pounds, in other embodiments between 5 to about 7 inch-pounds, or in one particular embodiment about 7 inch pounds. Other initial torque values may be used. This initial driving torque compares to a final driving torque of about 25 inch-pounds upon contact of the lug screw with the wire.

Figure 6A:
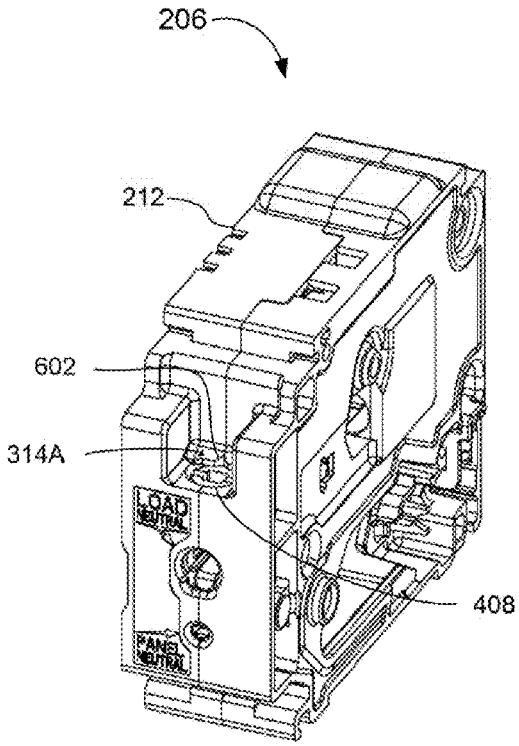
FIGS. 6A and 6B are two perspective views of an electronic pole of a two pole circuit breaker in accordance with one or more embodiments of the present invention. The FIG. 6A view is from the right side of the pole and the FIG. 6B view is from the left side of the pole.
Figure 6B:
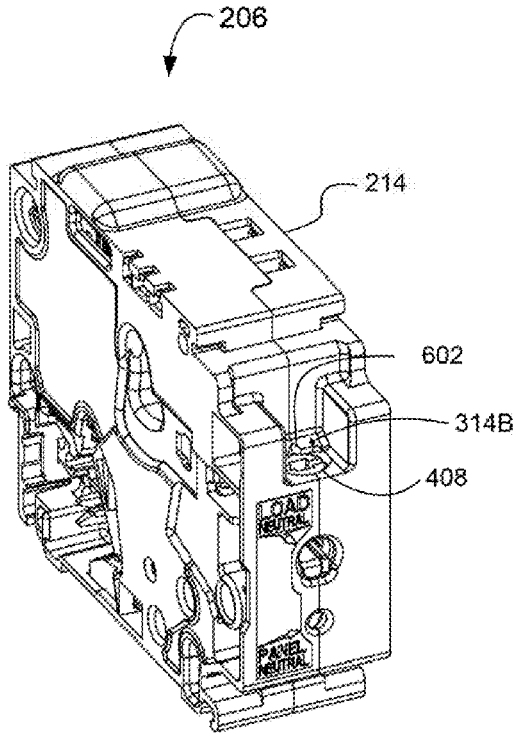

FIGS. 6A and 6B are perspective views, from the right and left respectively, of electronic pole 206. In these views, one or more embodiments of back-out stops 314A, 314B are depicted. In FIGS. 6A and 6B, back-out stops 314A, 314B are depicted as having two portions, wherein each is a part of and/or attached to electronic pole housing portions 212, 214, respectively. Back-out stops 314A, 314B are depicted as partially covering lug screw 408 at a position along the translational path of the lug screw 408, such that lug screw 408 may not back-out of lug body 405 (not shown). In addition, back-out stops 314A, 314B are depicted as allowing access to lug screw 408 by a tool (not shown). In addition, back-out stops 314A, 314B may cooperate to form an optional notch or cut-out 602, which may provide additional room for a tool to access lug screw 408. Other cutout shapes may be used.

Figure 7:
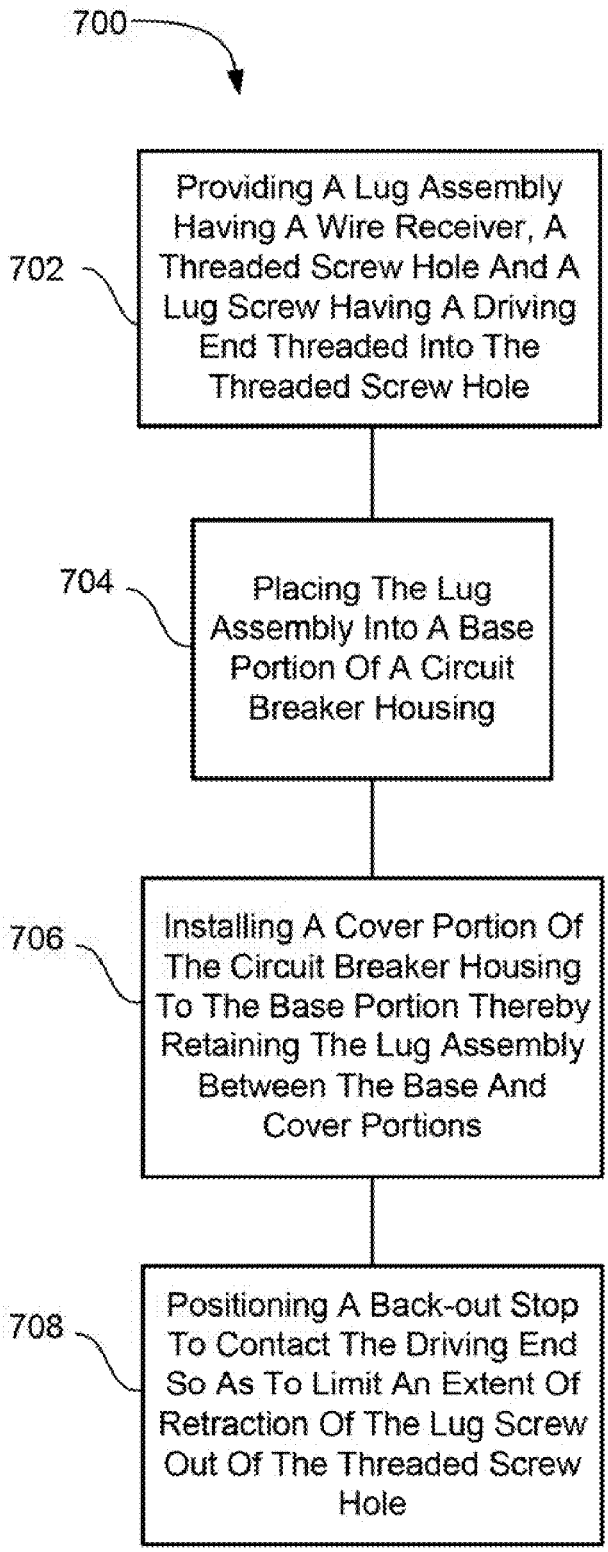
FIG. 7 is a flowchart depicting a method of the invention for manufacturing a portion of a circuit breaker.

According to another aspect, a method of manufacturing a portion of a circuit breaker is provided. As shown in FIG. 7, the method 700 includes providing a lug assembly having a wire receiver, a threaded screw hole and a lug screw having a driving end threaded into the threaded screw hole in 702. For example, referring to FIG. 3A-3C, the method 700 method 700 includes providing a lug assembly 301 having a wire receiver 306, a threaded screw hole 307 and a lug screw 308 having a driving end 310 threaded into the threaded screw hole 307 in 702. The method 700 further includes placing the lug assembly into a base portion of a circuit breaker housing, in 704. Again referring to FIG. 3A-3C, the method 700 further includes placing the lug assembly 301 into a base portion 302 of a circuit breaker housing, in 704. The method 700 also includes installing a cover portion of the circuit breaker housing to the base portion thereby retaining the lug assembly between the base and cover portions, in 706. Again referring to FIG. 3A-3C, the method 700 also includes installing a cover portion 311 of the circuit breaker housing to the base portion 302 thereby retaining the lug assembly 301 between the base and cover portions 302, 311, in 706. The method 700 also includes positioning a back-out stop to contact the driving end so as to limit an extent of retraction of the lug screw out of the threaded screw hole in 708. Again referring to FIG. 3A-3C, he method 700 also includes positioning a back-out stop 314 to contact the driving end 310 so as to limit an extent of retraction of the lug screw 308 out of the threaded screw hole 307 in 708.

Figure 8:
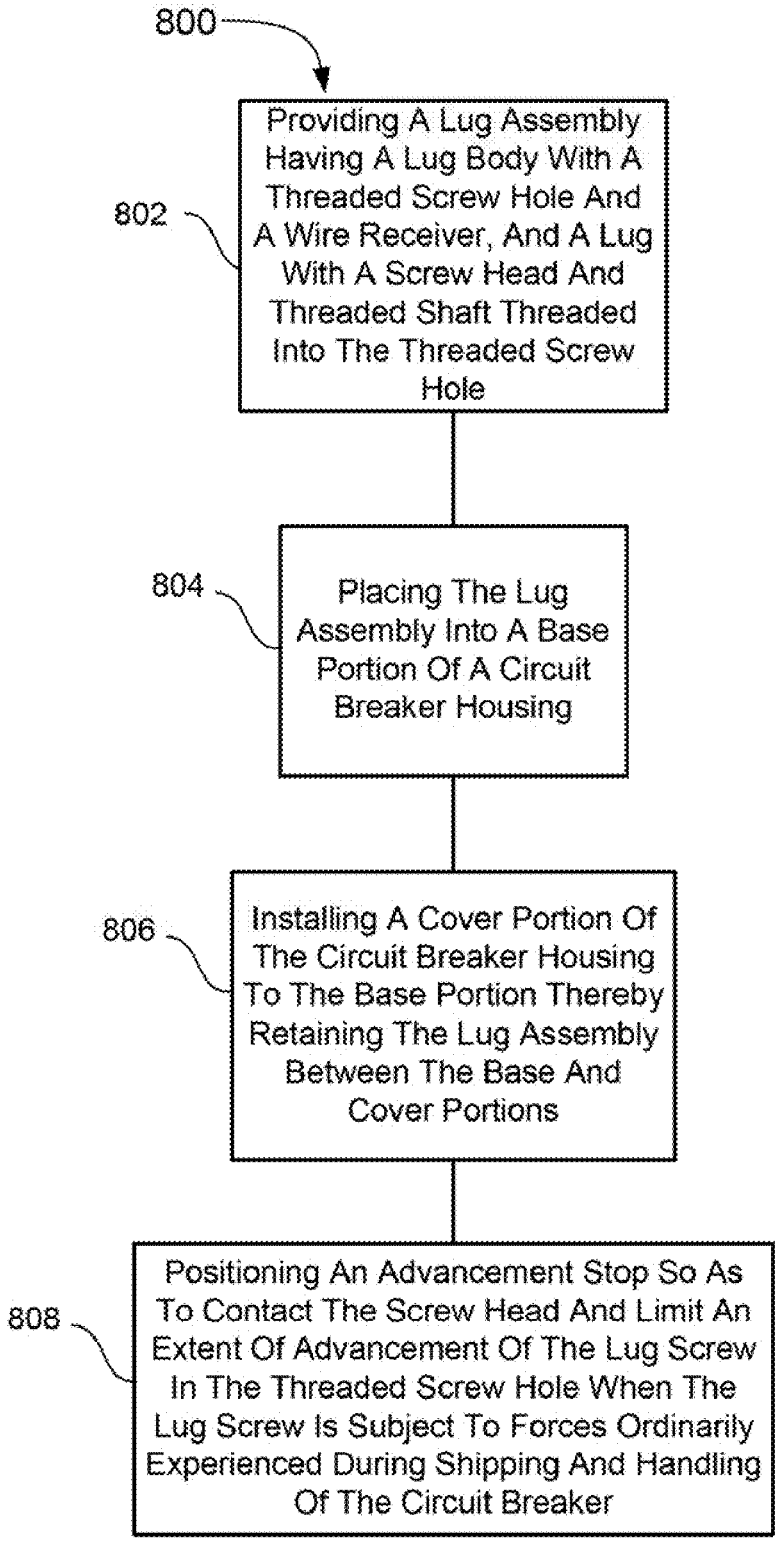
FIG. 8 is a flowchart depicting another method of the present invention for manufacturing a portion of a circuit breaker.

According to another aspect, another method 800 of manufacturing a portion of a circuit breaker is provided. As shown in FIG. 8, the method 800 includes providing a lug assembly having lug body with a threaded screw hole and a wire receiver, and a lug screw having a screw head and a driving end, the lug screw being threaded into the threaded screw hole, in 802. Referring to FIG. 3A-3C, the method 800 includes providing a lug assembly 301 having lug body 305 with a threaded screw hole 307 and a wire receiver 306, and a lug screw 308 having a screw head 309 and a driving end 310, the lug screw 308 being threaded into the threaded screw hole 307, in 802. The method 800 further includes placing the lug assembly into a base portion of a circuit breaker housing, in 804. Referring to FIG. 3A-3C, the method 800 includes placing the lug assembly 301 into a base portion 302 of a circuit breaker housing, in 804. The method 800 also includes installing a cover portion of the circuit breaker housing to the base portion thereby retaining the lug assembly between the base and cover portions, in 806. As shown in FIG. 3A-3C, the method 800 includes installing a cover portion 311 of the circuit breaker housing to the base portion 302 thereby retaining the lug assembly 301 between the base and cover portions 302, 311, in 806. The method 800 also includes positioning an advancement stop so as to contact the screw head and limit an extent of advancement of the lug screw in the threaded screw hole when the lug screw is subject to forces ordinarily experienced during shipping and handling of the circuit breaker, in 808. As shown in FIG. 3A-3C, the method 800 includes positioning an advancement stop 316 so as to contact the screw head 309 and limit an extent of advancement of the lug screw 308 in the threaded screw hole 307 when the lug screw 308 is subject to forces ordinarily experienced during shipping and handling of the circuit breaker, in 808.

Figure 9:
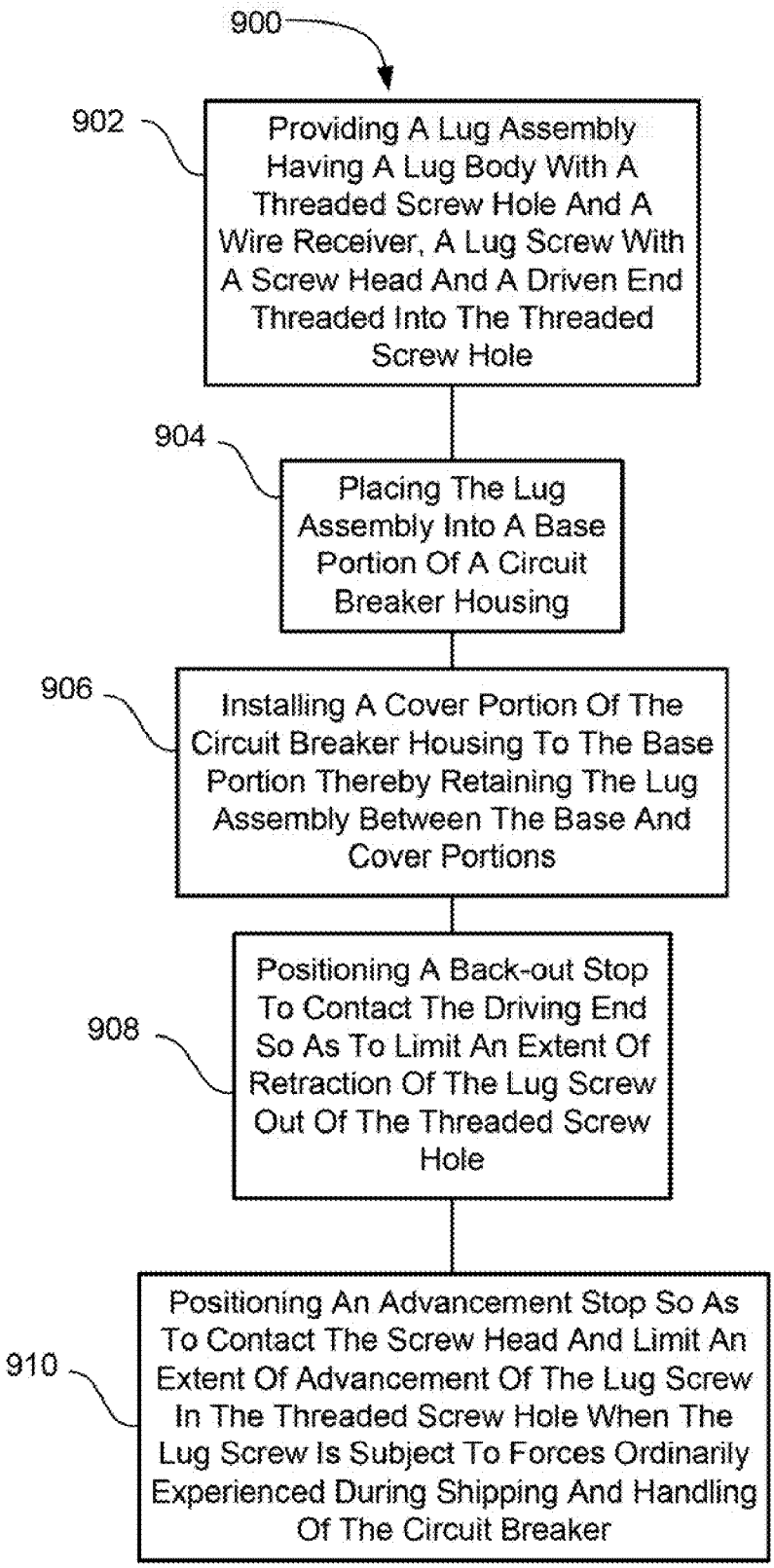
FIG. 9 is a flowchart depicting another method of the present invention for manufacturing a portion of a circuit breaker.

According to another aspect, a method of manufacturing a portion of a circuit breaker is provided. As shown in FIG. 9, the method 900 includes providing a lug assembly having lug body with a threaded screw hole and a wire receiver, and a lug screw threaded into the threaded screw hole, in 902. As shown in FIG. 3A-3C, the method 900 includes providing a lug assembly 301 having lug body 305 with a threaded screw hole 307 and a wire receiver 306, and a lug screw 308 threaded into the threaded screw hole 307, in 902. The method 900 further includes placing the lug assembly into a base portion of a circuit breaker housing, in 904. As shown in FIG. 3A-3C, the method 900 further includes placing the lug assembly 301 into a base portion 302 of a circuit breaker housing, in 904. The method 900 also includes installing a cover portion of the circuit breaker housing to the base portion thereby retaining the lug assembly between the base and cover portions, in 906. As shown in FIG. 3A-3C, the method 900 also includes installing a cover portion 311 of the circuit breaker housing to the base portion 302 thereby retaining the lug assembly 301 between the base and cover portions 302, 311, in 906. The method 900 also includes positioning a back-out stop to contact the driving end so as to limit an extent of retraction of the lug screw out of the threaded screw hole, in 908. As shown in FIG. 3A-3C, the method 900 also includes positioning a back-out stop 314 to contact the driving end 310 so as to limit an extent of retraction of the lug screw 308 out of the threaded screw hole 307, in 908. The method 900 also includes positioning an advancement stop so as to contact the screw head and limit an extent of advancement of the lug screw in the threaded screw hole when the lug screw is subject to forces ordinarily experienced during shipping and handling of the circuit breaker, in 910. As shown in FIG. 3A-3C, the method 900 also includes positioning an advancement stop 316 so as to contact the screw head 309 and limit an extent of advancement of the lug screw 308 in the threaded screw hole 307 when the lug screw 308 is subject to forces ordinarily experienced during shipping and handling of the circuit breaker, in 910.

While the invention is susceptible to various modifications and alternative forms, specific embodiments and methods thereof have been shown by way of example in the drawings and are described in detail herein. It should be understood, however, that it is not intended to limit the invention to the particular apparatus, systems or methods disclosed, but, to the contrary, the intention is to cover all modifications, equivalents and alternatives falling within the spirit and scope of the invention.

What is claimed is:

1. A circuit breaker, comprising:

a circuit breaker housing including a base portion and a cover portion, wherein the base portion and the cover portion form a compartment;

a lug assembly retained in the compartment of the circuit breaker housing, the lug assembly including a lug body forming a wire receiver, the lug body having a threaded screw hole in communication with the wire receiver, and a lug screw having a driving end and a threaded shaft inserted in the threaded screw hole;

a back-out stop formed by the base portion and the cover portion of the circuit breaker housing, the back-out stop positioned to contact the driving end so as to limit an extent of retraction of the lug screw out of the threaded screw hole; and an advancement stop of the circuit breaker housing adapted to limit advancement of an engagement end of the lug screw in the wire receiver.

2. The circuit breaker of claim 1, wherein the threaded shaft of the lug screw is engaged with the threaded screw hole; and wherein the back-out stop is configured to prevent the threaded shaft from disengaging the threaded screw hole.

3. The circuit breaker of claim 1, wherein the back-out stop is adapted to prevent backward movement of the driving end past the back-out stop.

4. The circuit breaker of claim 1, wherein the back-out stop is adapted to prevent the engagement end from disengaging from the threaded screw hole.

5. The circuit breaker of claim 1, wherein the back-out stop is configured to allow a driving tool to access and drive the lug screw by only covering a portion of the driving end.

6. The circuit breaker of claim 1, wherein the back-out stop is a molded, integral part of the circuit breaker housing.

7. The circuit breaker of claim 1, wherein the back-out stop is manufactured from one selected from the group of a thermoplastic material and a thermoset material.

8. The circuit breaker of claim 1, wherein the advancement stop is adapted to limit an extent to which an engagement end of the lug screw may advance through the threaded screw hole when the lug screw is subject to forces ordinarily experienced during shipping and handling of the circuit breaker.

9. The circuit breaker of claim 1, wherein the advancement stop is adapted to contact the lug screw and provide a selected initial driving torque when an installer drives the lug screw.

10. A circuit breaker, comprising:

a circuit breaker housing including a base portion and a cover portion, wherein the base portion and the cover portion form a compartment;

a lug assembly having lug body forming a wire receiver, the lug body with a threaded screw hole in communication with the wire receiver, and a lug screw having a threaded shaft connected to a screw head, wherein the threaded shaft is threaded into the threaded screw hole, and the lug assembly is retained in the compartment of the circuit breaker housing; and an advancement stop formed by the base portion and the cover portion of the circuit breaker housing, the advancement stop positioned to contact the screw head and limit an extent to which the threaded shaft may advance in the threaded screw hole and wire receiver when the lug screw is subjected to forces ordinarily experienced during shipping and handling of the circuit breaker.

11. The circuit breaker of claim 10, wherein the advancement stop is adapted to limit an extent to which the threaded shaft may be threaded into the threaded screw hole and limit an extent to which an engagement end of the lug screw enters the wire receiver.

12. The circuit breaker of claim 10, wherein the advancement stop is adapted to deform as the lug screw is driven by an installer.

13. The circuit breaker of claim 12, wherein the advancement stop is further adapted to provide a selected initial driving torque when the advancement stop contacts the lug screw as the installer drives the lug screw.

14. The circuit breaker of claim 10, wherein the advancement stop is a molded, integral part of the circuit breaker housing.

15. The circuit breaker of claim 10, wherein the advancement stop is manufactured from one selected from the group of a thermoset material and a thermoplastic material.

16. The circuit breaker of claim 10, wherein the advancement stop is adapted to prevent the lug screw from turning when the lug screw is subjected to forces ordinarily experienced during shipping and handling of the circuit breaker.

17. A method for manufacturing a circuit breaker, comprising:

providing a circuit breaker housing including a base portion and a cover portion;

providing a lug assembly having a lug body with a threaded screw hole and a lug screw having a driving end and a threaded shaft threaded into the threaded screw hole;

placing the lug assembly into the base portion of the circuit breaker housing;

installing the cover portion of the circuit breaker housing to the base portion thereby retaining the lug assembly in a compartment formed by between the base and cover portions;

forming a back-out stop from the base portion and the cover portion of the circuit breaker housing and positioning a the back-out stop to contact the driving end so as to limit an extent of retraction of the lug screw out of the threaded screw hole; and forming an advancement stop from the base portion and the cover portion of the circuit breaker housing and limiting advancement of an engagement end of the lug screw in a wire receiver with the advancement stop.

18. The method for manufacturing a circuit breaker of claim 17, further comprising preventing with the back-out stop a disengaging of the threaded shaft from the threaded screw hole.

19. The method for manufacturing a circuit breaker of claim 17, further comprising limiting with the advancement stop an extent to which the lug screw may advance through the threaded screw hole and enter the wire receiver when the lug screw is subject to forces ordinarily experienced during shipping and handling of the circuit breaker.

20. The method for manufacturing a circuit breaker of claim 19, comprising providing a selected initial driving torque with the advancement stop when an installer begins to drive the lug screw in contact with the advancement stop.

21. A method for manufacturing a circuit breaker, comprising:

providing a circuit breaker housing including a base portion and a cover portion;

providing a lug assembly having a lug body with a threaded screw hole and a wire receiver, and a lug screw with a screw head and threaded shaft threaded into the threaded screw hole;

placing the lug assembly into the base portion of the circuit breaker housing;

installing the cover portion of the circuit breaker housing to the base portion thereby retaining the lug assembly in a compartment formed by the base and cover portions; and forming an advancement stop from the base portion and the cover portion of the circuit breaker housing, and positioning the advancement stop so as to contact the screw head and limit an extent of advancement of the lug screw in the threaded screw hole and wire receiver when the lug screw is subject to forces ordinarily experienced during shipping and handling of the circuit breaker.

22. The method for manufacturing a circuit breaker of claim 21, further comprising deforming the advancement stop with the screw head when an installer drives the lug screw.

23. The method for manufacturing a circuit breaker of claim 21, further comprising:

breaking the advancement stop away from one or both of the base and cover portions when an installer drives the lug screw.

24. The method for manufacturing a circuit breaker of claim 21, further comprising providing a selected initial driving torque when an installer begins to drive the lug screw in contact with the advancement stop.

* * * * *